US005280699A

United States Patent [19]

Igel et al.

[11] Patent Number: 5,280,699

[45] Date of Patent: Jan. 25, 1994

[54] METHOD AND APPARATUS FOR DISPOSING AN END OF A ROVING BOBBIN FOR INTAKE INTO THE DRAFTING DEVICE OF A TEXTILE SPINNING MACHINE

[75] Inventors: Wolfgang Igel, Ebersbach/Fils; Manfred Samp, Deizisau, both of Fed. Rep. of Germany

[73] Assignee: Zinser Textilmaschinen GmbH, Ebersbach/Fils, Fed. Rep. of Germany

[21] Appl. No.: 738,600

[22] Filed: Jul. 31, 1991

[30] Foreign Application Priority Data

Jul. 31, 1990 [DE] Fed. Rep. of Germany ..... 4024358

[51] Int. Cl.[5] ..... D01H 9/10

[52] U.S. Cl. ..... 57/281; 57/269; 57/279

[58] Field of Search ..... 57/261, 262, 269, 270, 57/275, 278, 281, 279

[56] References Cited

U.S. PATENT DOCUMENTS

| | | | |
|---|---|---|---|
| 3,754,718 | 8/1973 | Abbott | 57/261 X |
| 4,438,622 | 3/1984 | Pons | 57/281 X |
| 4,845,935 | 7/1989 | Mack | 57/261 |
| 4,899,531 | 2/1990 | Mack | 57/261 |
| 4,944,146 | 7/1990 | Scaglia | 57/281 |
| 5,062,261 | 11/1991 | Fink | 57/281 |

FOREIGN PATENT DOCUMENTS

| | | | |
|---|---|---|---|
| 0213962 | 3/1987 | European Pat. Off. . | |
| 419968 | 4/1991 | European Pat. Off. | 57/281 |

*Primary Examiner*—Daniel P. Stodola
*Assistant Examiner*—Michael R. Manson
*Attorney, Agent, or Firm*—Shefte, Pinckney & Sawyer

[57] ABSTRACT

A method and apparatus for disposing an end of roving of a roving bobbin at a disposing location adjacent the drafting device of a spinning station of a textile spinning machine The roving end disposing apparatus, which is preferably mounted on a traveling service unit which travels to the spinning stations of the textile spinning machine to perform roving feed start operations thereat in which the feed of roving from a roving bobbin through a drafting device is started, includes a roving end support assembly for supporting a roving end for movement between a receipt location at which the assembly receives the roving end and the disposing location adjacent the drafting device at which the supported roving end is released either for engagement by the drafting device or piecing of the roving end with roving extending from another roving bobbin through the drafting device. The roving end disposing apparatus also includes a component for directing air against the roving end in correspondence with its release from the support assembly to facilitate movement of the roving end at an inclined direction into position for engagement by the drafting device or piecing with another roving. The air directing component preferably includes an air jet and an air source reversibly operable to apply suction through the air jet to secure the roving end during movement between the receipt location and the disposing location and to supply pressurized air against the roving end.

13 Claims, 4 Drawing Sheets

Fig. 4
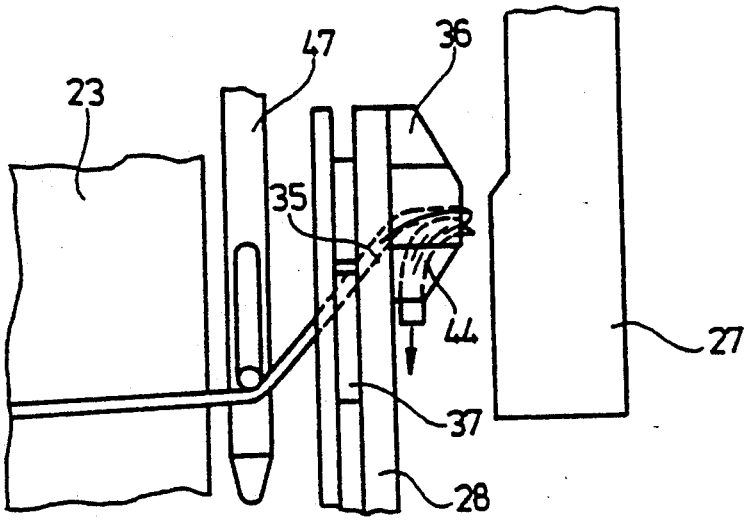
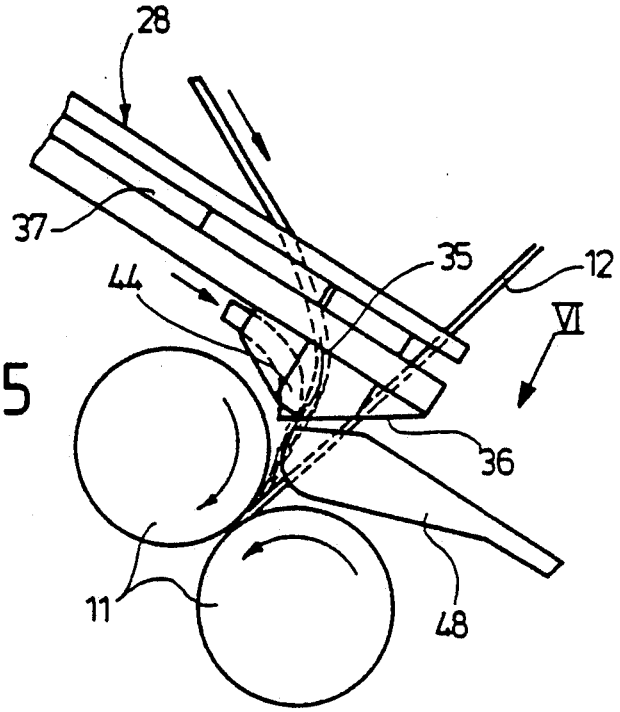
Fig. 5
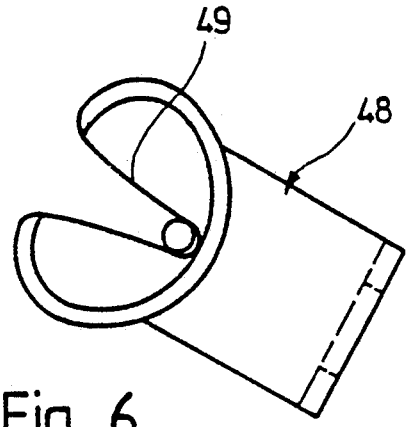
Fig. 6

METHOD AND APPARATUS FOR DISPOSING AN END OF A ROVING BOBBIN FOR INTAKE INTO THE DRAFTING DEVICE OF A TEXTILE SPINNING MACHINE

BACKGROUND OF THE INVENTION

The present invention relates to an apparatus for disposing an end of roving of a roving bobbin for intake of the roving end into the drafting device of a textile spinning machine and, more particularly, to an apparatus on a traveling service unit which is operable to perform a roving feed start operation.

European Patent Application No. 0 213 962 discloses a traveling service unit having an apparatus for disposing the roving end of a fresh roving bobbin at a location adjacent the drafting device of a textile spinning machine for piecing of the roving end with roving extending from another roving bobbin through the drafting device. The roving end disposing apparatus includes a generally V-shaped guide slot formed at its free end for guiding of the roving end therealong. An opening is formed in the side of the guide slot for directing air against the roving end disposed in the guide slot to ensure that the roving end remains in the guide slot during movement of the roving end disposing apparatus toward the disposing location. Once the roving end is disposed at the disposing location adjacent the roving already extending through the drafting device, piecing of the roving end is effected and roving is thereafter drawn from the fresh roving bobbin after severing of the roving supplied from the original roving bobbin.

However, a roving feed situation can arise in which there no roving present in the drafting device—e.g., the roving previously drafted through the drafting device has already been built on the package at the spinning station but roving has not continued to be drawn through the drafting device on account of, for example, the exhaustion of roving on the roving bobbin which had previously been supplying the spinning station or a break in the roving between the roving bobbin and the drafting device. Difficulties arise when a traveling service unit arrives at a spinning station at which the supply of roving has already been exhausted so that the roving no longer extends through the drafting device. At such spinning stations, it is no longer possible for the traveling service unit to piece a roving end from a fresh roving bobbin with roving extending through the drafting device and appropriate measures must then be undertaken to feed the roving end from the fresh roving bobbin into the drafting device.

Even on those textile spinning machines provided with a traveling service unit for responding to the upcoming exhaustion of roving from roving bobbins to exchange fresh roving bobbins therefor, the traveling service units of such spinning machines cannot reliably travel to each spinning station having a roving bobbin nearing exhaustion and, as a result, the roving may be completely exhausted at a spinning station before the traveling service unit arrives to exchange a fresh roving bobbin for the original roving bobbin. Although it is possible to control the movements of the traveling service unit to arrive at those spinning stations requiring fresh roving bobbins with sufficient lead time to ensure that the roving bobbins at such spinning stations are not yet exhausted, this solution is unsatisfactory since the traveling service unit may replace roving bobbins still having a relatively significant amount of roving thereon in order to travel in a timely manner to other spinning stations, thereby necessitating additional measures to handle the roving remaining on the replaced roving bobbins. Accordingly, the need exists for a method and apparatus which reliably disposes a roving end of a roving bobbin for reliable feeding of the roving end through a drafting device or reliable piecing of the roving end with roving from another roving bobbin.

SUMMARY OF THE INVENTION

Briefly described, the present invention provides an apparatus on the traveling service unit for disposing an end of roving of a roving bobbin at a disposing location adjacent the drafting device in a traveling service unit of the type for performing a roving feed start operation at a spinning station of a textile spinning machine by which the feed of roving from a roving bobbin through a drafting device of the spinning station is started. The apparatus includes a roving end support assembly for supporting an end of roving of one roving bobbin during movement of the roving end from a receipt location at which the roving end is received by the roving end support assembly to the disposing location adjacent the drafting device at which the supported roving end is released for a selected one of engagement by the drafting device and piecing of the roving end with roving extending from another roving bobbin through the drafting device. Also, the apparatus includes means for directing air against the roving end in correspondence with the disposing thereof at the disposing location by the roving end support assembly to effect movement of the roving end into position for the selected one of engagement by the drafting device and piecing with roving of the another roving bobbin.

According to one aspect of the present invention, the air directing means preferably includes a nozzle for jetting a stream of air therefrom against the roving end to direct the roving end toward the roving extending from the another roving bobbin in advance of the drafting device.

According to another aspect of the present invention, the drafting device includes a pair of intake rollers forming a nip therebetween and the air directing means includes a nozzle for jetting a stream of air therefrom against the roving end to effect movement of the roving end toward the nip.

According to another feature of the one aspect of the present invention, the air directing means includes a nozzle for jetting a stream of air therefrom against the roving end in a jet direction and the roving end support assembly includes a guide member having a guide slot therein. The guide slot is for guiding the roving end upon its exit from the roving end support assembly in an exit direction inclined with respect to the direction of travel of roving traveling through the drafting device. The jet direction is selected to direct movement of the exiting roving end in a direction inclined toward the direction of travel of roving through the roving device in advance of the drafting device, whereby the stream of air promotes movement of the exiting roving end against roving traveling through the drafting device to facilitate piecing of the roving end with the roving traveling through the drafting device.

According to a further feature of the another aspect of the present invention, the air directing means includes a nozzle for jetting a stream of air therefrom against the roving end in a jet direction and the roving end support assembly includes a guide member having a guide slot therein. The guide slot is for guiding the roving end upon its exit from the roving end support assembly in an exit direction inclined with respect to the direction of travel of roving traveling through the drafting device. The jet direction is selected to direct movement of the exiting roving end in a direction inclined toward the drafting device in advance of the drafting device, whereby the stream of air promotes movement of the exiting roving end into position for engagement by the drafting device.

According to an additional feature of the one aspect of the present invention, the apparatus further comprises suction means, selectively connectable to the nozzle, for applying suction into the nozzle to draw the roving end into the nozzle during movement of the roving end between the receipt location and the disposing location.

According to a further additional feature of the one aspect of the present invention, the guide slot includes an arcuate portion for guiding the exiting roving end and the nozzle includes an opening adjacent the arcuate portion of the guide slot, the opening being oriented for directing the stream of air in a jet direction selected relative to the exit direction to form an acute angle therebetween.

According to a different aspect of the present invention, a method for disposing an end of roving of a roving bobbin at a disposing location adjacent the drafting device of a spinning station of a textile spinning machine is provided. The method includes engaging an end of roving of one roving bobbin at a receipt location and moving the engaged roving end of the one roving bobbin to a disposing location adjacent the drafting device at which the supported engaged roving end is released for a selected one of engagement by the drafting device and piecing of the roving end with roving extending from another roving bobbin through the drafting device. Also, the method includes directing air against the roving end in correspondence with the disposing thereof at the disposing location to effect movement of the roving end into position for the selected one of engagement by the drafting device and piecing with the roving of the another roving bobbin.

According to an additional aspect of the present invention, there is provided a method for disposing an end of roving of a roving bobbin at a disposing location during a roving feed start operation at a spinning station of a textile spinning machine. The method includes supporting an end of roving of one roving bobbin at a disposing location adjacent the drafting device of a spinning station of a textile spinning machine. Also, the method includes directing a stream of air against the roving end to facilitate movement of the roving end along a direction inclined in the direction of travel of roving through the drafting device into position for a selected one of engagement by the drafting device and piecing of the roving end with roving extending from another roving bobbin through the drafting device. Also, the method preferably includes applying suction to the roving end to draw the roving end into an air jet prior to positioning the roving end at the disposing location and the step of directing air includes directing air against the roving end to effect movement of the roving end out of the air jet.

BRIEF DESCRIPTION OF THE DRAWINGS

FIG. 4 is an enlarged front elevational view of a portion of the traveling service unit shown in FIG. 1, a portion of the fresh roving bobbin supported by the traveling service unit, and the top portion of the roving end disposing apparatus;

FIG. 5 is an enlarged front elevational view of the top portion of the roving end disposing apparatus in its release position for releasing a roving end at a disposing location adjacent the intake rollers of a drafting device of the spinning station shown in FIG. 1;

FIG. 6 is a top plan view of a guide eyelet of the spinning station shown in FIG. 5, as viewed in the direction indicated by the arrow VI.

DETAILED DESCRIPTION OF THE PREFERRED EMBODIMENT

Figure 1:
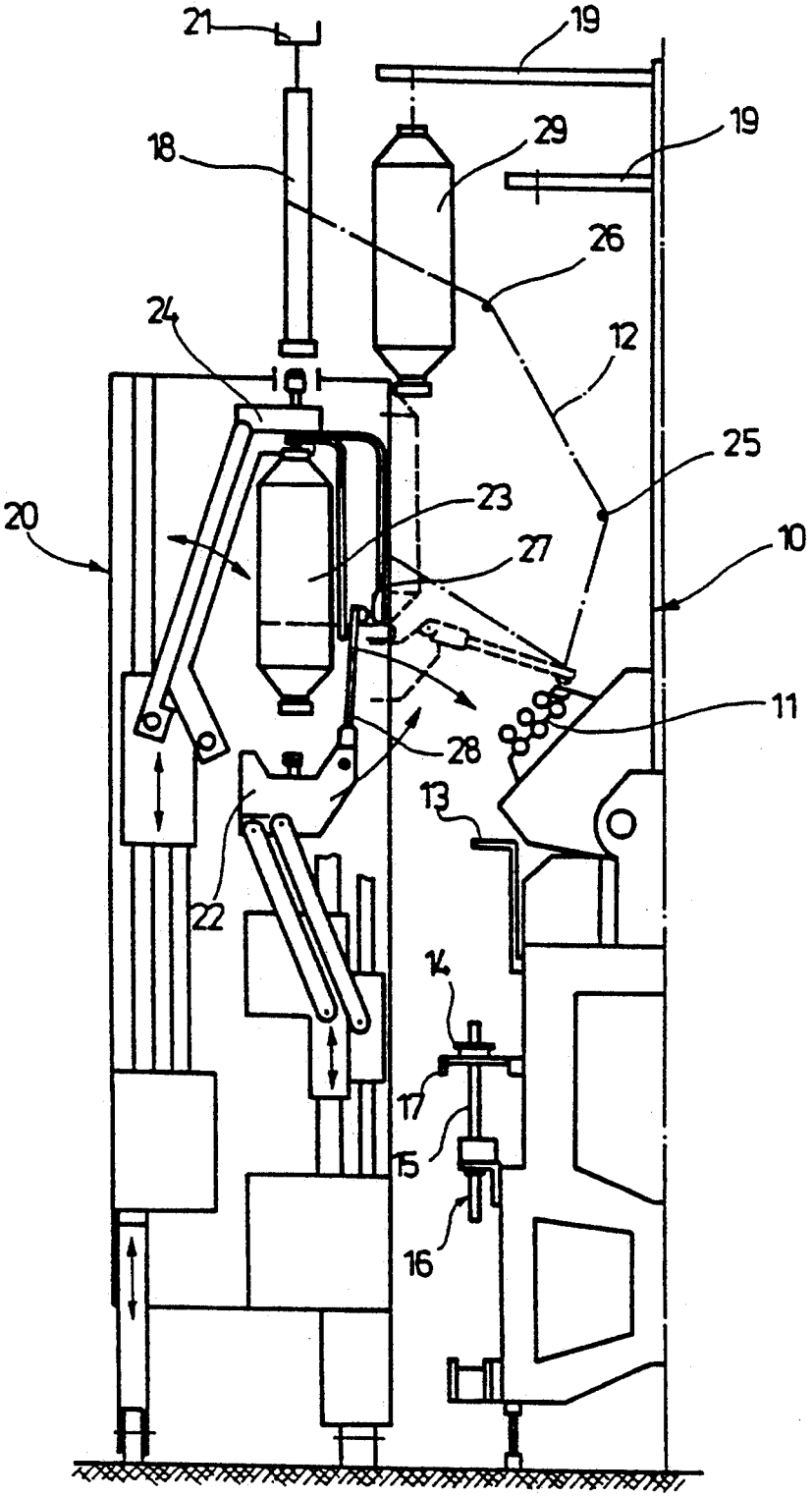
FIG. 1 is a front elevational view of a spinning station of a textile spinning machine and a traveling service unit for performing a roving feed start operation at the spinning station, a portion of the traveling service unit being cut away to show the preferred embodiment of the roving end disposing apparatus of the present invention.

In FIGS. 1-6, the preferred embodiment of the roving end disposing apparatus 28 of the present invention is illustrated. The roving end disposing apparatus 28, as seen in FIG. 1, is mounted to a traveling service unit 20 of the type for performing a roving feed start operation at a spinning station 10 of a textile spinning machine, the roving feed start operation for starting the feed of roving from a roving bobbin through a drafting device 11 of the spinning station 10.

The textile spinning machine, which can be, for example, a conventional ring spinning machine, has a plurality of spinning stations disposed along each side thereof (only the spinning station 10 being illustrated) and the textile spinning machine includes a pair of creels 19 for supporting a plurality of roving bobbins 18 thereon during the drawing of roving therefrom by the drafting devices of the individual spinning stations. The roving 12 drawn from each roving bobbin is drawn through a pair of conventional roving guides such as, for example, the roving guides 25, 26 along which a roving 12 is drawn from a roving bobbin 18 to the drafting device 11 of the spinning station 10. The textile spinning machine includes a spare bobbin frame 21 for supporting a supply of fresh roving bobbins 29 and, additionally, for supporting a plurality of empty roving bobbins 18 which have already been transferred from the creels 19.

The spinning station 10 includes a roving guide component 13 for guiding the yarn drafted through the drafting device 11 to a traveler ring 14 on a ring bank 17. The traveler ring 14 builds the yarn onto a tube 15 being rotated on a spindle 16.

The traveling service unit 20 travels in a direction parallel to the row of spinning stations to individually service the spinning stations including performing roving feed start operations at those spinning stations at which the roving being drawn from a roving bobbin is nearly exhausted or has been exhausted, or at which the feed of roving has been interrupted by, for example, a break in the roving. The traveling service unit 20 is provided with a bobbin exchange apparatus for exchanging full roving bobbins supported on the spare bobbin frame 21 for bobbins supported on the creels 19. The bobbin exchange apparatus includes a means 24 for temporarily supporting a bobbin and a means 22 for transferring a bobbin between and among a selected one of the creels 19, the spare bobbin frame 21, and the temporarily supporting means 24. The bobbin exchange apparatus additionally includes a means for displacing an end of roving of a full bobbin from the full bobbin to an extending disposition ready for engagement by the roving end disposing apparatus 28 for subsequent disposing of the roving end at a disposing location adjacent the drafting device 11.

The transferring means 22 includes a pair of vertically extending guide shafts fixedly mounted to the frame of the traveling service unit. A carrier assembly includes a pair of portions, each slidably movably disposed on a respective one of the guide shafts, and conventional means for slidably moving the carrier assembly vertically along the guide shafts. One free end of each of a pair of pivot arms is pivotally connected to a respective one of the sliding portions of the carrier assembly and the other free end of each respective pivot arm is pivotally connected to a platform member. The pivot arms are pivotally movable relative to the carrier assembly by conventional pivoting means (not shown).

A post member is rotatably supported on the platform member and is compatibly configured with the inner diameter of a roving bobbin for receiving a bobbin thereon. The post member additionally includes a conventional stabilizing means to releasably secure a roving bobbin inserted thereon. A pulley (not shown) is coaxially fixedly mounted to the post member and a pulley belt (not shown) is trained around the pulley and the drive pulley of a conventional drive means (not shown) for driving rotation of the post member about its axis by the drive means. Through the vertical movement of the carrier assembly along the guide shafts and the pivoting of the pivot arms relative to the carrier assembly and the platform member, the post member is movable upwardly and downwardly and laterally toward and away from the spinning station.

The temporarily supporting means 24 includes a pair of vertical guide shafts fixedly mounted to the frame of the traveling service unit and a carrier assembly slidably supported on the cylindrical shafts and including conventional drive means (not shown) for vertically driving the carrier assembly along the guide shafts. As best seen in FIG. 1, the free end of a pair of pivot arms are pivotally connected to the carrier assembly for pivoting relative thereto and the other free ends of the pivot arms are pivotally connected to a platform member. The pivot arms are reversibly pivotable in the directions indicated by the arrow in FIG. 1 by a conventional pivot drive means (not shown) to move the platform member laterally toward and away from the spinning stations.

The temporarily supporting means 24 additionally includes a first post member having a shaft portion rotatably supported on the platform member and a roving bobbin receiving portion extending vertically downwardly therefrom for supporting a roving bobbin inserted thereon. A pulley is coaxially fixedly mounted to the shaft portion. A pulley belt (not shown) is trained around the pulley and the drive pulley of a conventional drive means (not shown) mounted on the platform member for driving rotation of a roving bobbin mounted to the first post member.

The temporarily supporting means 24 additionally includes a second post member coaxially fixedly mounted to the shaft portion for rotation therewith and extending vertically upwardly beyond the shaft for supporting a roving bobbin inserted thereon. The second post member includes a limit ring coaxially fixedly mounted thereto for engagement with the base of a roving bobbin to stabilize the roving bobbin in a supported disposition on the second post member.

The displacing means includes a suction applying means 27. The suction applying means 27 includes a suction end for applying suction to a roving end of a full bobbin temporarily supported on the first post member. The suction end is mounted on a conduit (not shown) which is rotatably supported on the platform member by conventional bearing assemblies. The conduit is communicated with a conventional vacuum source (not shown) mounted on the traveling service unit for applying a suction through the suction end. Additionally, the displacing means includes a roving end intermediate engaging member rotatably supported on the platform member by conventional ball bearing assemblies.

The suction conduit includes a vertical portion (not shown) rotatably received in the platform member and defining the suction applying means axis about which the suction applying means is pivoted relative to the platform member, a radially extending portion extending radially from the suction applying means axis and an axially extending portion extending from the radially extending portion to the suction end. A first gear (not shown) is coaxially fixedly mounted to the vertical portion.

The roving end intermediate engaging member includes an axial portion (not shown) which is mounted via a mounting member (not shown) to a second gear (not shown) coaxially fixedly mounted to the shaft portion of the first post member for rotatably supporting the roving end intermediate engaging member on the platform member for selective pivoting of the roving end intermediate engaging member about the axis of the first post member. The roving end intermediate engaging member additionally includes a radially extending portion extending radially from the axial portion with respect to the axis of the first post member and an axially extending portion extending axially from the radially extending portion and terminating at a hook end member in the shape of a hook.

The radially extending portion of the roving end intermediate engaging member extends radially with respect to the axis of the first post member to an extent sufficient to dispose the axial portion radially outwardly from the circumference of a full roving bobbin 23 supported on the first post member. The hook end member extends generally tangentially with respect to a full roving bobbin 23 supported on the post member.

The first gear is rotatably driven by a conventional gear drive means and the first and second gears meshingly engage with one another to transmit rotation of the first gear to the second gear.

Figure 2:
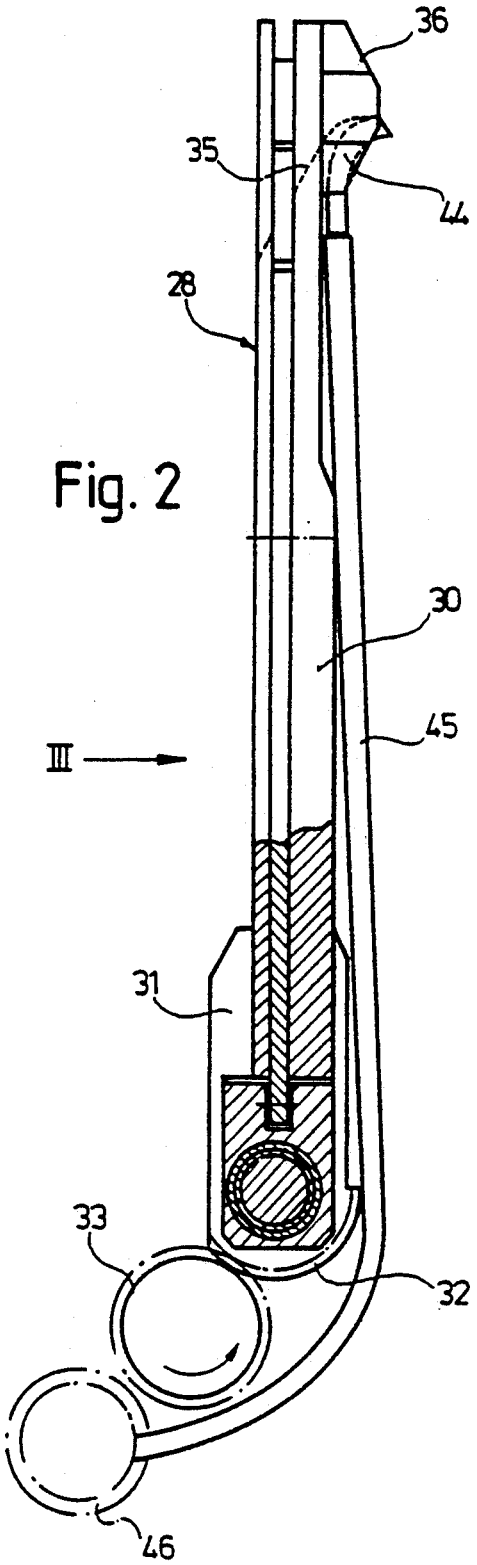
FIG. 2 is an enlarged front elevational view, in partial vertical section, of the roving end disposing apparatus shown in FIG. 1.
Figure 3:
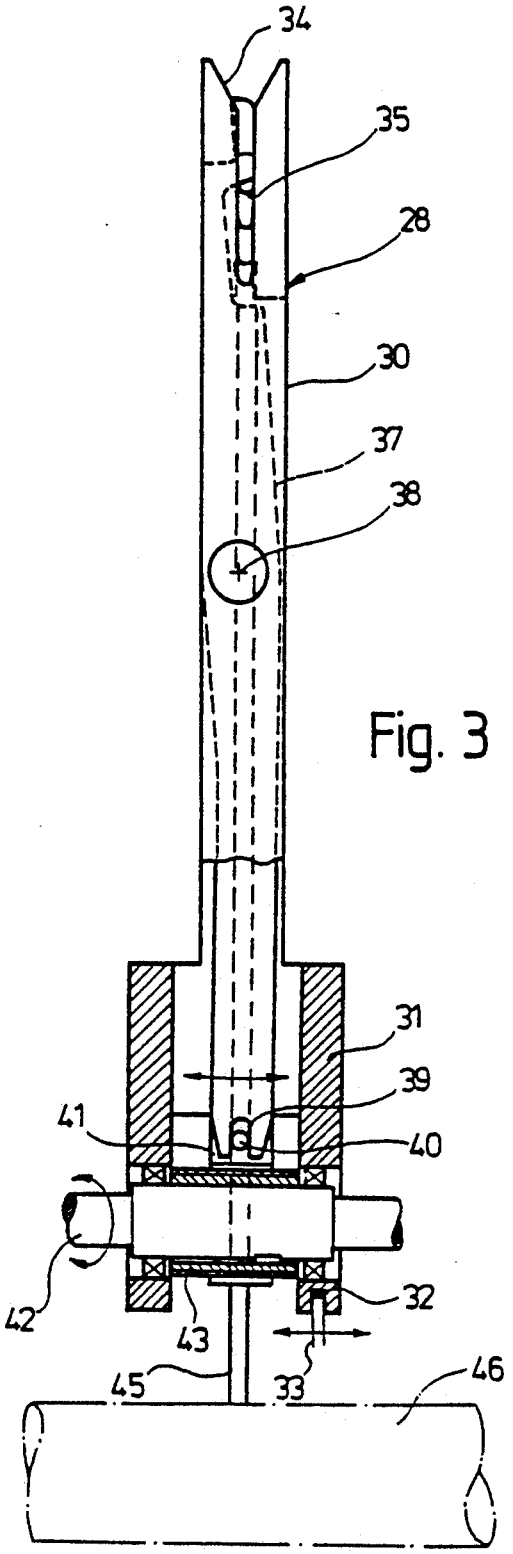
FIG. 3 is a side elevational view of the portion of the roving end disposing apparatus shown in FIG. 2, as viewed in the direction indicated by the arrow III.

As seen in FIGS. 2 and 3, the roving end disposing apparatus 28 includes a pivot arm 30 having a pivot mount 31 for pivotally mounting the pivot arm 30 to a pivot shaft 42 for pivoting of the pivot arm about the axis of the pivot shaft. The pivot shaft 42 is rotatably supported by a support assembly (not shown) mounted to the platform member of the transferring means 22. An arcuately shaped portion 32 formed on the underside of the pivot mount 31 has a rack of teeth (not shown) adapted to be meshingly engaged by the teeth of a drive gear 33 for driving the pivotal movement of the pivot arm 30 about the pivot shaft 42 by the drive gear 33.

The free end portion of the pivot arm 30 includes a guide slot element 34 having, as seen in FIG. 3, a generally V-shaped slot for guiding of a roving end therealong. As seen in FIG. 2, the vertex 35 of the guide slot includes a linear portion extending from a back side of the pivot arm 30 at an incline upwardly toward an opposed front side of the pivot arm and an arcuate portion extending from the linear portion and curving therefrom in a direction from the longitudinal axis of the pivot arm 30 toward a lateral axis perpendicular to the longitudinal axis of the pivot arm. The arcuate portion of the vertex 35 is formed by an extension element 36 extending laterally outwardly from the front side of the pivot arm 30.

As seen in FIG. 3, the roving end disposing apparatus 28 includes a clamping bracket 37 pivotally mounted by a pivot 38 to the pivot arm 30 for pivoting of the clamping bracket 37 about a lateral axis. A lower end portion of the clamping bracket 37 is formed with a traveler slot 39 for the travel therein of a pin 40 extending laterally outwardly from a sliding block 41. The sliding block 41 is formed with a linear rack of gear teeth (not shown) adapted for meshing engagement with an outer worm formed on the outer circumferential surface of a cylindrical sleeve 43. The inner surface of the cylindrical sleeve 43 is formed with an inner worm adapted to meshingly engage with an outer worm formed on the circumference of the pivot shaft 42. Rotation of the pivot shaft 42 is transmitted by its outer worm to the inner worm of the cylindrical sleeve 43 to effect corresponding rotation of the outer worm of the cylindrical sleeve 43 and corresponding linear movement of the sliding block 41 in a selected one of the opposed directions shown by the arrow with two opposed ends in FIG. 3.

As the sliding block 41 linearly moves, the traveler slot 39 of the clamping bracket 37 follows the movement of the pin 40 and the clamping bracket 37 is correspondingly pivoted about the axis of the pivot 38 between a non-clamping position in which it is out of engagement with a roving end supported in the guide slot of the guide member 34 and a clamping position in which the clamping element 37 and the guide slot compressively engage a roving end therebetween to prevent movement of the roving end relatively along the guide slot. The clamping bracket 37 is also pivotable to clamp the roving 12 being drawn from the original roving bobbin 18 to effect severing of the roving 12, in a manner described in more detail below.

As seen in FIG. 2, the roving end disposing apparatus 28 additionally includes means for directing air against a roving end supported in the guide slot, the air directing means including a air source 46, a conduit 45, and an air jet 44. One end of the conduit 45 is connected to the air source 46 and the other end of the conduit is connected to the air jet 44. The air jet 44 is mounted in the extension element 36 of the pivot arm 30 and is operable to direct streams of air against a roving end supported in the guide slot of the guide slot element 34.

The air source 46 is configured as a reversibly operable suction and air supply source. In its suction mode, the air source 46 is operable as a conventional vacuum source to apply suction through the conduit 45 and the air jet 44. In its positive pressure mode, the air source 46 is operable as a conventional positive pressure air source for supplying pressurized air through the conduit 45 and the air jet 44.

The air source 46 is mounted on the traveling service unit 20. The conduit 45 is preferably composed of a flexible-type tubing to continuously communicate the air source 46 with the air jet 44 throughout movement of the transferring means 21 relative to the traveling service unit 20.

The roving end disposing apparatus 28 operates as follows to dispose the roving end of a fresh roving bobbin 29 at a disposing location adjacent the drafting device 11 for either the intaking of the disposed roving end into the drafting device 11 (in the event that there is no length of roving extending from the roving bobbin 18 to the drafting device 11) or the piecing of the roving end with the roving 12 of the roving bobbin 18 (if the roving 12 is still being drawn from the roving bobbin 18 through the drafting device 11). Through an appropriate conventional sensor or other mechanism (not shown), the traveling service unit 20 is requested to travel to the spinning station 10 to perform a roving feed start operation thereat. The traveling service unit, once it is positioned adjacent the spinning station 10, operates as follows to perform a roving end disposing operation thereat. The roving bobbin 18 supported on one of the creels 19 may be a roving bobbin which is currently supplying roving to the drafting device 11 of the spinning station or may be an empty roving bobbin, its supply of roving having been fully drawn off. Initially, the transferring means 22 is operated to vertically and laterally manipulate the post member to effect insertion of the post member into a full roving bobbin 29 supported on the spare bobbin frame 21. If necessary, the pivot arms of the temporarily supporting means 24 are manipulated to clear the temporarily supporting means 24 from the path of travel of the transferring means 22. The full roving bobbin 29 engaged by the post member is vertically raised in conventional manner to effect removal of the full roving bobbin from the spare bobbin frame 21 and the carrier assembly of the transferring means 22 is subsequently downwardly moved to effect lowering of the full roving bobbin 29 which is now supported entirely by the post member.

The transferring means 22 is sufficiently lowered to permit lateral movement of the platform member of the temporarily supporting means 24 over the top of the supported full roving bobbin 29. Accordingly, the platform member is then disposed over the top of the supported full roving bobbin 29 with its first post member in axial alignment with the full roving bobbin through appropriate manipulation of the pivot arms. Thereafter, the carrier assembly of the transferring means 22 is operated to raise the supported full roving bobbin 29 to effect insertion of the top of the full roving bobbin onto the first post member for supporting engagement thereby. The transferring means 22 is then lowered to effect removal of its post member from the bottom of the full roving bobbin 29, which is now fully supported by the first post member on the temporarily supporting means 24.

If the roving from the roving bobbin 18 has not yet been completely drawn off from the roving bobbin, the transferring means 22 is operated in correspondence with the completion of the drawing off, or shortly before the completion of the drawing off, of the roving to position the post member for insertion into the bottom of the roving bobbin to effect removal of the bobbin from the creel 19 on which it is supported. The transferring means 22 raises the feed bobbin in conventional manner to effect disengagement of the top of the bobbin from its supported engagement by the creel 19. Thereafter, the roving bobbin 18, which is completely supported on the post member of the transferring means 22, is moved laterally outwardly with respect to the spinning station to position the roving bobbin 18 for supporting engagement by the spare bobbin frame 21. In correspondence with this lateral and vertical movement of the transferring means 22, the pivot arms of the temporarily supporting means 24 are appropriately manipulated to move the full bobbin 29 supported on the temporarily supporting means 24 laterally outwardly with respect to the spinning station out of interference with the travel of the transferring means 22. Once the transferring means 22 has aligned the roving bobbin 18 with an empty engaging member on the spare bobbin frame 21, the transferring means 22 is operated to raise the roving bobbin 18 to insert the roving bobbin 18 onto the spare bobbin frame 21. Subsequently, the transferring means 22 is lowered to effect removal of the post member from the bottom of the empty or nearly empty roving bobbin.

In correspondence with the transfer of the roving bobbin 18 to the spare bobbin frame 21, the displacing means is operated to position the roving end of the full roving bobbin 29 in an extending disposition ready for engagement by the roving end disposing apparatus 28 for feeding to the drafting device 11. In this regard, the suction applying means 27 and the roving end intermediate engaging member are initially disposed in respective initial positions in which the suction end is positioned relatively closely adjacent the circumference of the full roving bobbin 29. The suction end is disposed at a height relative to the full roving bobbin 29 generally at a predetermined axial extent of the full roving bobbin in which the roving end has preferably been disposed during a prior preparatory step. For example, the roving end of each of the full roving bobbins 29 supported on the spare bobbin frame 21 may each have undergone a roving end disposition step in which their roving ends were disposed in the lower axial third of the bobbin.

In correspondence with the start of the roving end engagement by the displacing means, the transferring means 22 is lowered via appropriate operation of the carrier assembly to position the roving end disposing apparatus 28 vertically below the level of the hooked end of the roving end intermediate engaging member and the suction end of the suction applying means 27.

With the suction end of the suction applying means positioned in the initial position, the drive means is operated to drive the pulley belt to thereby effect rotation of the full roving bobbin 29 via rotation of the pulley and the first post means. As the full roving bobbin 29 is rotated in an unwinding direction, a suction is applied through the suction end to engage the roving end, which is preferably at the same vertical location as the suction end.

In correspondence with the engagement of the roving end by the suction end, the drive means is operated to effect synchronous movement of the suction applying means 27 and the roving end intermediate engaging member from their respective initial positions to their respective feeding engagement positions. The gear mounted to the roving end intermediate engaging member is rotated in one direction and this rotation of the gear effects rotation of the gear mounted to the suction applying means 27 in the opposite rotational direction. Since the axis about which the suction applying means 27 pivots (the axis of its axial portion) is offset radially from the axis of the first post member, the pivoting of the suction applying means 27 from its initial position to its feeding engagement position acts to move the roving end, which is continuously engaged by the suction end through the suction applied therethrough, to a position more radially displaced from the circumference of the full roving bobbin 29 than the position of the roving end when it is engaged by the suction end in the initial position of the suction applying means 27. This positioning of the roving end results from the path of travel of the suction end from the initial position of the suction end adjacent the circumference of the full roving bobbin to a position displaced from the full roving bobbin.

Due to the synchronous movement of the suction applying means 27 and the roving end intermediate engaging member, the hook end member engages the roving end at a position thereon intermediate the portion of the roving end engaged by the suction end and the portion of the roving end still disposed on the circumference of the full roving bobbin 29 and maintains engagement with the roving end as the roving end intermediate engaging member completes its movement from its initial position to its feeding engaging position. The gear ratios of the first and second gears associated with the suction applying means and the roving end intermediate engaging member is preferably selected such that the respective feeding engagement positions in which the suction applying means 27 and the roving end intermediate engaging member are disposed at the completion of their pivoting are generally in alignment with one another along a feeding radius relative to the axis of the first post member. Accordingly, the roving end extends linearly along the feeding radius between the suction end and the hook end member when the suction applying means 27 and the roving end intermediate engaging member are in their respective feeding engagement positions.

In correspondence with the movement of the suction applying means 27 and the roving end intermediate engaging member into their respective feeding engagement positions, the carrier assembly of the transferring means 22 is raised to effect movement of the roving end disposing apparatus 28 into its roving end receipt position radially intermediate the suction end and the hook end member. As the roving end disposing apparatus 28 is raised by upward movement of the transferring means 22, the guide slot of the guide slot element 34, which is aligned with the feeding radius, receives the roving end therein. As seen in FIG. 4, the roving end received in the guide slot of the guide slot element 34 is supported in the vertex 35 of the guide slot. In correspondence with the receipt of the roving end in the guide slot, the clamping bracket 37 is moved from its non-clamping position to its clamping position via appropriate linear movement of the sliding block 41 through rotation of the pivot shaft 42 and the cylindrical sleeve 43, to thereby effect compressive engagement of the roving end in the guide slot between the clamping bracket 37 and the vertex 35 of the guide slot.

With the roving end of the full roving bobbin 29 now securely gripped by the roving end disposing apparatus 28, the transferring means 21 is raised to effect insertion of the bottom of the full roving bobbin 29 onto its post member for supporting engagement of the full roving bobbin by the transferring means 21 and, simultaneously, to effect disengagement of the top of the full roving bobbin from the first post means of the temporarily supporting means 24. With the full roving bobbin 29 now completely supported by the transferring means 21, the suction applying means and the roving end intermediate engaging member 47 are preferably moved via synchronous rotation of the gears from their respective feeding engagement positions to their initial positions and thereby out of interference with subsequent lateral movement of the transferring means 21 toward the spinning station. Through appropriate pivoting of the pivot arms relative to the carrier assembly, the platform member of the transferring means 21 is thereafter moved laterally in a direction from the traveling service unit 20 toward the spinning station and the carrier assembly is raised along the guide shafts to effect movement of the full roving bobbin 29 to the standby position shown in the broken lines in FIG. 1.

In this standby position, the roving end disposing apparatus 28 is pivoted relative to the platform member to the broken line position shown in FIG. 1 to position the roving end at the disposing location adjacent the drafting device 11.

The movement of the suction applying means 27 relative to the roving end disposing apparatus 28 effects tearing of the portion of the roving end extending between the suction applying means and the roving end disposing apparatus and thereby creates a free end portion of the roving end which extends beyond the extension member 36 of the roving end disposing apparatus 28. In correspondence with this tearing action of the roving end, the air source 46 is reversibly operated to apply a suction through the conduit 45 and the air jet 44 to the newly created free end portion of the roving end and this suction acts to draw in the free end portion into the air jet 44, as shown in FIG. 4. Accordingly, as the roving end disposing apparatus 28 is pivoted to the broken line position shown in FIG. 1 via meshing engagement of the drive gear 33 with the rack of the arcuate portion 32 of the pivot arm 30, the free end portion of the roving end engaged by the roving end disposing apparatus remains securely engaged in a protected position and this advantageously permits a relatively rapid pivoting of the pivot arm 30 without the risk that the roving end will move out of its secured position in the guide slot or that the free end portion of the roving end will snag on a component of the textile spinning machine.

Once the roving end is disposed at the disposing location, the operation of the air source 46 is again reversed to cease the application of suction through the air jet 44 and to, instead, apply positive pressure air through the conduit 45 and the air jet 44, which causes the free end portion of the roving end to be blown out of the air jet 44. The continued application of the positive air to the air jet 44 allows the air jet to direct an air stream against the free end portion of the roving end which beneficially facilitates the threading of the roving end into the drafting device 11 or, alternatively, the piecing of the roving end with the roving 12 still extending through the drafting device 11. As seen in FIG. 5, in a situation in which the roving 12 from the roving bobbin 18 is still being drawn through the drafting device 11, the roving 12 extends through the drafting device 11 along a direction of travel DT which is perpendicular to the axes of the pairs of drafting rollers of the drafting device 11 such as, for example, the axis IR of the pair of intake rollers of the drafting device. The free end portion of the roving end which has been blown out of the air jet 44 is oriented along a direction of travel RE due to the continuing application of air streams against the free end portion by the air jet 44. The direction of travel RE of the roving end is along a tangent of the arcuate portion of the guide slot. The direction of travel of the roving end RE is advantageously at a relatively small acute angle with respect to the direction of travel DT of the roving 12 so that piecing of the roving end with the roving 12 is facilitated. The direction AJ of the streams of air produced by the air jet 44 are at a relatively small angle with respect to the direction of travel RE of the roving end but at a slightly greater acute angle with respect to the direction of travel DT of the roving 12 to thereby promote movement of the free end portion of the roving end in the direction toward the roving 12.

The intake rollers of the drafting device 11 are preferably formed with elastomeric surfaces exhibiting relatively high coefficients of friction to thereby promote engagement and intake of the roving end between the rollers. Additionally, the introduction of the roving end to the intake rollers, either for the drafting of the roving end alone through the rollers or for piecing of the roving end with the roving 12 still extending from the drafting device 11, can be further enhanced by positioning a roving guide 48 intermediate the pair of intake rollers and the roving end disposing apparatus 28. The roving guide member 48 is preferably formed with a conduit extending from its free end for drawing in air passing over the free end of the roving guide member. As seen in FIG. 6, the roving guide member 48 is formed with a generally V-shaped slot 49 along whose vertex the roving end travels as the roving end travels from the arcuate portion of the guide slot of the roving end disposing apparatus 28 toward the nip between the intake rollers of the drafting device 11.

In a situation in which the roving 12 still extends from the roving bobbin 18 through the drafting device 11, the continuous pressure of the air streams along the air stream direction of travel AJ against the free end portion of the roving end maintains the roving end in contact with the roving 12 and the roving end is thus drawn by the roving 12 into the drafting device 11, with the roving end and the roving 12 piecing with one another during their common travel through the drafting device 11. After the lapse of a predetermined period of time following the disposing of the roving end for piecing with the roving 12, the roving 12 is severed. The severing of the roving 12 can be accomplished, for example, by movement of the roving end disposing apparatus 28 to a position in which the clamping bracket 37 is manipulated to clamp the roving 12 between the clamping bracket and the roving end disposing apparatus 28 and severing of the roving 12 is then effected through movement of the roving end disposing apparatus 28. Alternatively, a conventional roving cutting or severing device (not shown) can be operated to sever the roving 12.

Figure 7:
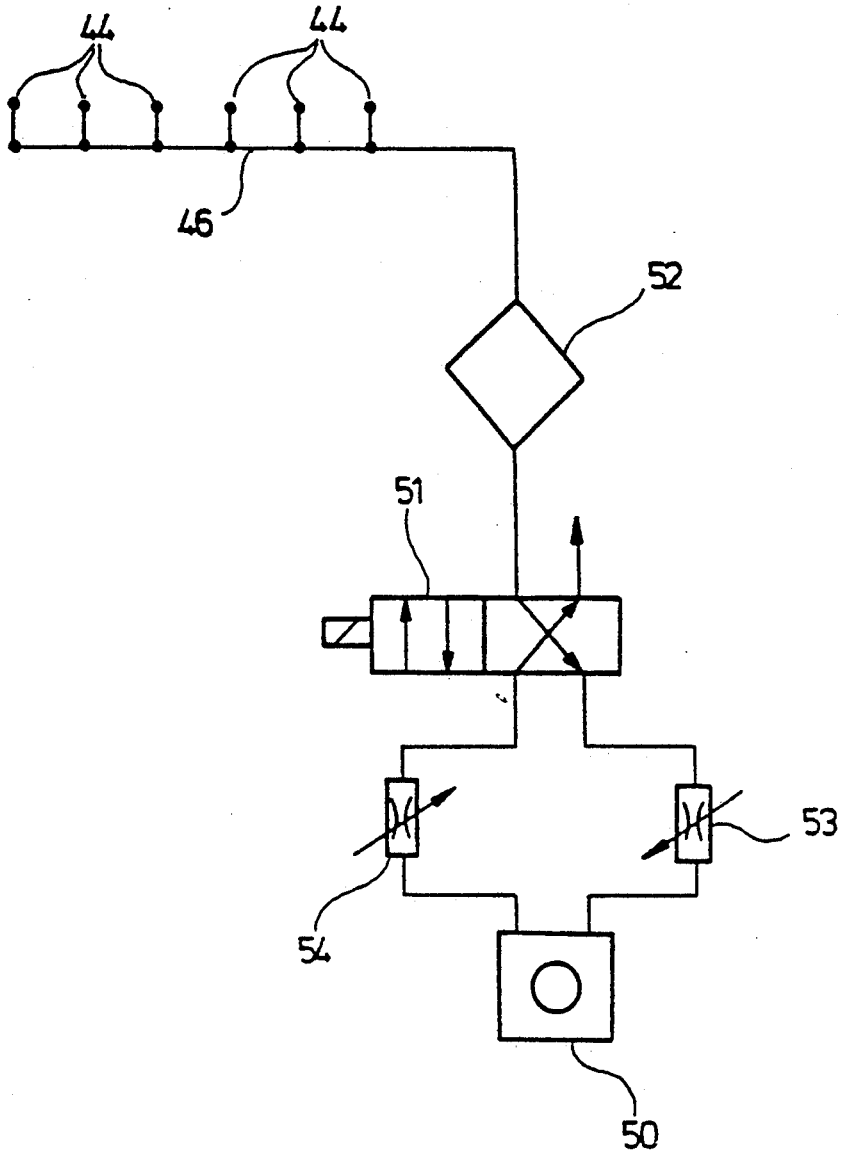
FIG. 7 is a schematic plan view of a pneumatic control circuit for controlling the operation of a plurality of roving end disposing apparatuses of the present invention.

In FIG. 7, a pneumatic control assembly is illustrated for controlling the application of suction or pressurized air through a plurality of the air jets 44. This pneumatic control device is designed for use in a configuration of the traveling service unit 20 in which the temporarily supporting means 24 and the transferring means 22 are each provided with several uniformly spaced post members for simultaneous transfer and/or support of the roving bobbins of several adjacent spinning stations. In this configuration, the traveling service unit 20 includes a plurality of the roving end disposing apparatuses 28 in like number as the transferring means 22 and the temporarily supporting means 24 and the air jets 44 of the roving end disposing apparatuses 28 are commonly communicated with a common conduit 46, as schematically illustrated in FIG. 7. The common conduit 46 is connected to a filter 52 and the filter 52 is connected to a magnetic valve component 51. A compressor 50 is connected via two separate conduits to the magnetic valve component 51, one of the separate conduits having a control valve 53 and the other separate conduit having a control valve 54. The magnetic valve component 51 is selectively operated to communicate the air jets 44 with the compressor 50 through a selected one of the two separate conduits between the magnetic valve component 51 and the compressor 50 to thereby selectively apply suction through the air jets 44 or to apply pressurized air through the air jets. The filter 52 filters air drawn into the air jets 44 when suction is applied through the air jets. The filter 52 can alternatively be disposed between the magnetic valve component 51 and the suction inlet of the compressor 50 to perform its filter function thereat. The valve members 53, 54 provide the capability to selectively adjust the suction or pressurized air provided to the air jets 44.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. In a traveling service unit of the type for performing a roving feed start operation at a spinning station of a textile spinning machine by which the feed of roving from a roving bobbin through a drafting device of the spinning station is started, an apparatus on the traveling service unit for disposing an end of roving of a roving bobbin at a disposing location adjacent the drafting device, comprising:

a roving end support assembly for supporting an end of roving of one roving bobbin during movement of the roving end from a receipt location at which the roving end is received by the roving end support assembly to the disposing location adjacent the drafting device at which the supported roving end is released for a selected one of engagement by the drafting device and piecing of the roving and with roving extending from another roving bobbin through the drafting device; and a means for directing air against the roving end including a nozzle for jetting a stream of air therefrom against the roving end to direct the roving end toward the roving extending from the another roving bobbin in advance of the drafting device.

2. In a traveling service unit, an apparatus according to claim 1 wherein the air directing means includes a nozzle for jetting a stream of air therefrom against the roving end in a jet direction and the roving end support assembly includes a guide member having a guide slot therein, the guide slot for guiding the roving end upon its exit from the roving end support assembly in an exit direction inclined with respect to the direction of travel of roving traveling through the drafting device, the jet direction being selected to direct movement of the exiting roving end in a direction inclined toward the direction of travel of roving through the roving device in advance of the drafting device, whereby the stream of air promotes movement of the exiting roving end against roving traveling through the drafting device to facilitate piecing of the roving end with the roving traveling through the drafting device.

3. In a traveling service unit, an apparatus according to claim 2 and further comprises suction means, selectively connectable to the nozzle, for applying suction into the nozzle to draw the roving end into the nozzle during movement of the roving end between the receipt location and the disposing location.

4. In a traveling service unit, an apparatus according to claim 2 wherein the guide slot includes an arcuate portion for guiding the exiting roving end and the nozzle includes an opening adjacent the arcuate portion of the guide slot, the opening being oriented for directing the stream of air in a jet direction selected relative to the exit direction to form an acute angle therebetween.

5. In a traveling service unit of the type for performing a roving feed start operation at a spinning station of a textile spinning machine by which the feed of roving from a roving bobbin through a drafting device of the spinning station is started, the drafting device includes a pair of intake rollers forming a nip therebetween; an apparatus on the traveling service unit for disposing an end of roving of a roving bobbin at a disposing location adjacent the drafting device, comprising:

a roving end support assembly for supporting an end of roving of one roving bobbin during movement of the roving end from a receipt location at which the roving end is received by the roving end support assembly to the disposing location adjacent the drafting device at which the supported roving end is released for a selected one of engagement by the drafting device and piecing of the roving end with roving extending from another roving bobbin through the drafting device; and a means for directing air against the roving end including a nozzle for jetting a stream of air therefrom against the roving end to direct the roving end toward the nip.

6. In a traveling service unit, an apparatus according to claim 5 wherein the air directing means includes a nozzle for jetting a stream of air therefrom against the roving end in a jet direction and the roving end support assembly includes a guide member having a guide slot therein, the guide slot for guiding the roving end upon its exit from the roving end support assembly in an exit direction inclined with respect to the direction of travel of roving traveling through the drafting device, the jet direction being selected to direct movement of the exiting roving end in a direction inclined toward the drafting device in advance of the drafting device, whereby the stream of air promotes movement of the exiting roving end into position for engagement by the drafting device.

7. In a traveling service unit, an apparatus according to claim 6 and further comprising suction means, selectively connectable to the nozzle, for applying suction into the nozzle to draw the roving end into the nozzle during movement of the roving end from the receipt location to the disposing location.

8. In a traveling service unit, an apparatus according to claim 6 wherein the guide slot includes an arcuate portion for guiding the exiting roving end and the nozzle includes an opening adjacent the arcuate portion of the guide slot, the opening being oriented for directing the stream of air in a jet direction selected relative to the exit direction to form an acute angle therebetween.

9. A method for disposing an end of roving of a roving bobbin at a disposing location adjacent the drafting device of a spinning station of a textile spinning machine, comprising:

engaging an end of roving of one roving bobbin at a receipt location;

moving the engaged roving end of the one roving bobbin to a disposing location adjacent the drafting device at which the supported engaged roving end is released for a selected one of engagement by the drafting device and piecing of the roving end with roving extending from another roving bobbin through the drawing device; and directing air against the roving end in correspondence with the disposing thereof at the disposing location to direct the roving end toward a selected one of the roving extending from the another roving bobbin and the drafting device.

10. A method for disposing an end of roving of a roving bobbin according to claim 9 and further comprising applying suction to the roving end during movement of the roving end between the receipt location and the disposing location to stabilize the roving end during movement between the two locations.

11. A method for disposing an end of roving of a roving bobbin at a disposing location during a roving feed start operation at a spinning station of a textile spinning machine, the method comprising:

supporting an end of roving of one roving bobbin at a disposing location adjacent a drafting device of a spinning station of a textile spinning machine; and directing a stream of air against the roving end along a direction inclined in the direction of travel of roving through the drafting device to direct the roving end toward a selected one of the roving extending from another roving bobbin in advance of the drafting device and the drafting device.

12. A method according to claim 11 and further comprising applying suction to the roving end to draw the roving end into an air jet prior to positioning the roving end at the disposing location and the step of directing air includes directing air against the roving end to effect movement of the roving end out of the air jet.

13. In a traveling service unit of the type for performing a roving feed start operation at a spinning station of a textile spinning machine by which the feed of roving from a roving bobbin through a drafting device of the spinning station is started, the roving traveling through the drafting device in a predetermined direction of travel, an apparatus on the traveling service unit for disposing an end of roving of a roving bobbin at a disposing location adjacent the drafting device, comprising:

a roving end support assembly for supporting an end of roving of one roving bobbin during movement of the roving end from a receipt location at which the roving end is received by the roving end support assembly to the disposing location adjacent the drafting device at which the supported roving end is released for a selected one of engagement by the drafting device and piecing of the roving end with roving extending from another roving bobbin through the drafting device, the roving end support assembly including a guide member for guiding the roving end of the one roving bobbin in an exit direction substantially acutely inclined relative to the predetermined direction of travel of roving through the drafting device; and means for directing a stream of air against the roving end in correspondence with the disposing thereof at the disposing location by the roving end support assembly to direct the roving end towards a selected one of the roving extending from another roving bobbin and the drafting device, the means for directing a stream of air being operable to direct the air stream in an air stream direction inclined relative to the predetermined direction of travel of roving through the drafting device at an angle at least equal to the angle between the exit direction and the predetermined direction of travel of roving through the drafting device but less than 180° as measured in the same direction as the substantially acute angle formed between the exit direction and the predetermined direction of travel of roving through the drafting device, whereby the air stream promotes movement of the exiting roving end into position for a selected one of engagement of the exiting roving end by the drafting device and piecing of the exiting roving end with roving of the another roving bobbin.

* * * * *